US005179382A

United States Patent [19]

Decker

[11] Patent Number: 5,179,382

[45] Date of Patent: Jan. 12, 1993

[54] GEODESIC RADAR RETRO-REFLECTOR

[75] Inventor: Elmond E. Decker, Dayton, Ohio

[73] Assignee: The United States of America as represented by the Secretary of the Air Force, Washington, D.C.

[21] Appl. No.: 865,543

[22] Filed: Apr. 9, 1992

[51] Int. Cl.[5] ..... H01Q 15/18

[52] U.S. Cl. ..... 342/8

[58] Field of Search ..... 342/7, 8, 10

[56] References Cited

U.S. PATENT DOCUMENTS

| | | | |
|---|---|---|---|
| 2,450,417 | 10/1948 | Bossi | 9/8 |
| 2,763,000 | 9/1956 | Graham | 342/7 |
| 3,039,093 | 6/1962 | Rockwood | 342/7 |
| 3,103,662 | 9/1963 | Gray et al. | 343/18 |
| 3,153,235 | 10/1964 | Chatelain | 342/8 |
| 3,277,479 | 10/1966 | Struble, Jr. | 343/18 |
| 4,119,965 | 10/1978 | Kaszyk | 343/18 C |
| 4,695,841 | 9/1987 | Billard | 342/8 |
| 5,097,265 | 1/1992 | Aw | 342/7 |

*Primary Examiner*—Mark Hellner

*Attorney, Agent, or Firm*—Thomas L. Kundert; Donald J. Singer

[57] ABSTRACT

An improved radar retro-reflector providing overlapping coverage at low angles of elevation comprises a plurality of three-corner retro-reflectors made of electromagnetically reflective material lying in three planes which intersect each other at right angles. The individual retro-reflectors are supported between a horizontal base and a platform mounted above the base, and are interconnected to each other and to the base and to the platform in a geodesic configuration. Additional three-corner reflectors may be mounted atop the platform in back-to-back configuration. The radar retro-reflector may be foldable into a compact generally flattened storage position by making the device out of a plurality of hingedly connected triangular panels controlled by a hydraulic or other actuating system.

16 Claims, 4 Drawing Sheets

GEODESIC RADAR RETRO-REFLECTOR

RIGHTS OF THE GOVERNMENT

The invention described herein may be manufactured and used by or for the Government of the United States for all governmental purposes without the payment of any royalty.

BACKGROUND OF THE INVENTION

The present invention is directed to countermeasures devices and in particular to an improved passive radar decoy capable of projecting a uniformly large radar cross section over a wide angle of incidence.

Since the inception of radar guided weapon systems as viable threats to airborne platforms, much effort has been concentrated on developing countermeasures against such threats. The use of chaff and electronic jamming have been developed and employed by airborne platforms as effective countermeasures against the radar assisted weapon systems.

Ground and sea based installations are also susceptible to attack from radar guided weapons and passive countermeasure devices are being developed to provide protection from the radar assisted threats. The purpose of the passive countermeasure devices is to either conceal a potential target from detection by a surveillance type radar or to serve as a decoy against radar guided missiles. The concealment type devices are designed to enhance the radar clutter environment surrounding a target and should produce radar returns that are indistinguishable from the target it is protecting. The decoy type countermeasure device is designed to shift or relocate the radar centroid of the target as seen by the radar guided missile thereby causing the missile to miss its intended target.

A characteristic of all passive radar decoys is that when energy from a radar guided weapon impinges on their surface they must be capable of reradiating a large amount of this energy in the direction of the radar's receiver. A measure of the amount of radar energy incident on a target that is reradiated in the direction of the radar's receive antenna is known as the target's radar cross section (RCS). If the radar's transmit and receive antennas are located together the RCS is called monostatic RCS, otherwise the term bistatic RCS is used. Typically, the radar decoy is designed to present RCS that is much greater than the object it is designed to protect.

A second characteristic of a passive radar decoy is that the large RCS remains relatively large over a wide range of radar operating frequencies. Additionally, if the radar decoy is to function without prior knowledge as to the location of the radar threat, i.e. no decoy steering capability is employed, it must be capable of providing the large RCS characteristic over a wide range of radar viewing angles.

The basic building blocks used in the construction of typical radar decoys are the three-sided (trihedral) triangular corner reflectors. The corner retro-reflectors are most frequently used because of their ability to redirect a large portion of the incident radar energy back toward a monostatic radar and over a wide range of radar viewing angles. Traditionally, the individual corner reflectors have been arranged into a set of eight corner reflectors by effectively placing the reflectors back-to-back with four reflectors on top and four inverted reflectors on the bottom.

An example of an eight corner reflector is shown in U.S. Pat. No. 4,119,965 which discloses a foldable radar target such as might be utilized on small boats. The radar target comprises a base plate to which four top quarter plates and four bottom quarter plates are hingedly connected along first base sides thereof. The quarter panels are movable from a face-to-face collapsed position with respect to the base plate to an upright attitude, in which second base sides of each top and bottom quarter panel are respectively aligned proximal to each other along a line that is generally vertical and perpendicular to the normal horizontal disposition of the base plate.

Other examples of eight corner back-to-back retro-reflectors are shown in U.S. Pat. Nos. 3,103,662 and 2,450,417.

A significant deficiency of the prior art eight corner reflectors, lies in the fact that any one of the individual retro-reflectors operates as a reflector only over a solid angle of about 60°, so that when one installs them into a back-to-back configuration where they physically occupy 90° and work only over 60°, a large part of the desired spherical coverage is either seriously degraded or non-existent. The 60° limit on the functional properties of a single retro-reflector can best be visualized by looking into a corner and observing the three orthogonal sides that comprise the corner. Realizing that retro-reflection occurs only when electromagnetic rays strike all three surfaces, one can slowly rotate the corner in any direction and notice the reduction in the visible portion of at least one of the three surfaces. This visible reduction is a direct measure of the loss of performance of the retro-reflector. When rotated to the point where one side disappears totally, the unit has been reduced to the functional characteristics of a two-sided corner reflector. At only exactly this angle will the two-sided corner reflector provide an excellent reflective capability and at all other rotational angles it will not. Such deficiencies in total spherical coverage cannot be tolerated in defense applications where battle strategy and survivability of personnel and equipment depend on full, total, angular coverage by the decoy.

SUMMARY OF THE INVENTION

It is therefore an object of the present invention to overcome the deficiencies of the prior art eight corner reflectors and provide an improved radar retro-reflector device having uniform high reflective properties over a large angle of incidence.

It is another object of the invention to provided a radar retro-reflector device in which at least eight trihedral retro-reflectors are mounted in a geodesic configuration around an equatorial plane.

It is yet another object of the present invention to provide an improved radar retro-reflector device that is capable of being collapsed and folded into a compact storage position.

It is another object of the present invention to provide a pop-up radar retro-reflector device that may be deployed from a compact stored position to an operational position in a substantially short period of time by remote control.

The radar retro-reflector according to the invention comprises a plurality of three-corner retro-reflectors made of electromagnetically reflective material such as aluminum, lying in three planes which intersect each other at right angles. The three-corner retro-reflectors are supported between a horizontal base and a platform mounted above the base, and base, and are interconnected to each other and to the base and to the platform in a geodesic configuration. The preferred embodiment calls for eight three-corner retro-reflectors separated 45° in azimuth and 27.6° in elevation to provide overlapping coverage around the entire periphery of the radar retro-reflector at low angles of elevation. For higher angles of elevation, four three-corner retro-reflectors may be mounted on top of the platform in conventional back-to-back configuration.

A feature of the invention is that the radar retro-reflector may be collapsed or folded into a compact storage position by making the device out of a plurality of individual hingedly connected triangular panels. To do this the base and platform are rectangular, i.e. square shaped and the hypotenuse edge of each of the triangular panels is made the same length as a side of the base and platform. A first set of four triangular quarter Panels each has a side edge hingedly connected to a side of the base, and a second set of four triangular quarter panels each has a side edge hingedly connected to a side of the platform. Third and fourth sets of four triangular quarter panels each have a side edge hingedly connected to a second side edge of the first and second sets of four triangular quarter panels, respectively. In addition, the third and fourth sets of four triangular quarter panels each have a second side edge hingedly connected to each other. Fifth and sixth sets of four triangular quarter panels each have a side edge hingedly connected to a third side edge of the first and second sets of four triangular quarter panels to complete the eight individual three-corner retro-reflectors.

A seventh set of four triangular quarter panels each having a side edge hingedly connected to an upper surface of the platform along two intersecting lines forms the four three-corner retro-reflectors on top of the platform.

The fifth, sixth, and seventh sets of triangular quarter panels are each moved from a folded generally flattened position to a deployed position by sets of hydraulic or electromechanical panel actuators. The first four sets of triangular quarter panels are moved from a folded generally flattened position to a deployed position by movement of the platform from a stored position adjacent the base, to a deployed position spaced apart from the base. Movement of the platform is controlled by a hydraulic or electromechanical piston mounted in a housing beneath the base. A single control system operates the piston and the three sets of panels actuators.

Other objects, features, and advantages of the invention will be apparent from the following detailed description, claims and accompanying illustrative drawings.

DETAILED DESCRIPTION

Figure 1:
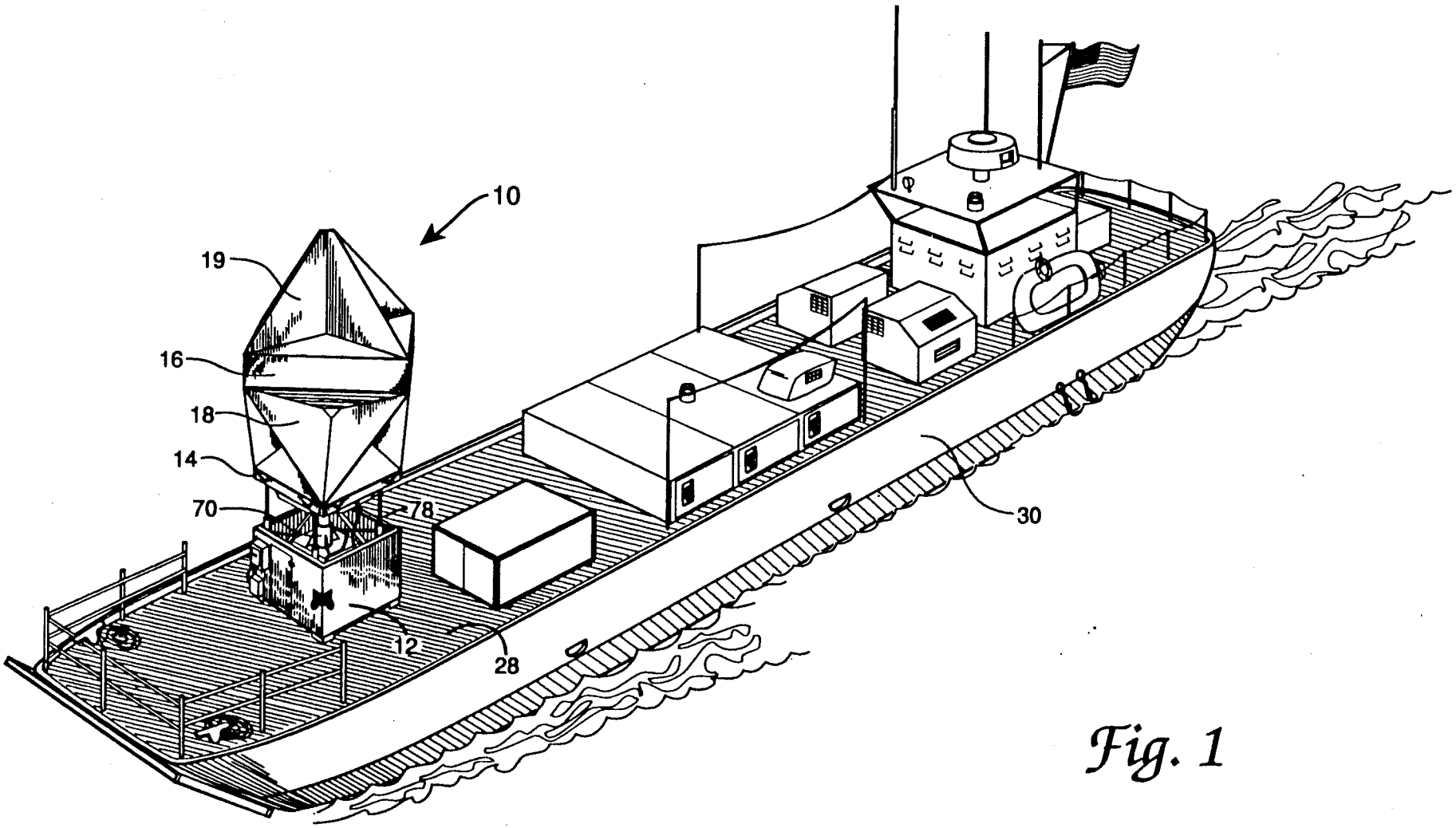
FIG. 1 is a perspective view of a naval ship having deployed on the deck thereof a radar retro-reflector constructed in accordance with the present invention.

The present invention is useful for protecting from attack by radar guided missiles, a variety of different kinds of targets including land-based targets such as radar and communications stations, and sea-based targets such as ships and platforms. FIG. 1 shows a radar retro-reflector 10 according to a preferred embodiment of the invention mounted on the forward deck 28 of a drone ship 30 such as a U.S. Navy LCM 8. Notwithstanding the relatively small size of ship 30 in comparison with a cruiser, aircraft carrier, or other large warship, the radar retro-reflector 10 operates to return a high level of emissive electromagnetic radiation to a radar seeker of a guided missile and thus simulates the signature return of a much larger ship. Electromagnetic energy entering an aperture of radar retro-reflector 10 impinges upon three mutually perpendicular reflective surfaces and goes back to the source in a constructive phase relationship (all additive). A relatively small physical size retro-reflector of approximately 6–10 feet outside edge length will return an amount of energy equivalent to, or greater than larger but random surface structures such as found on warships. This is due to the fact that reflectivity at the X-band (8–12 KMHZ) increases with the fourth power of the inside edge length of a retro-reflector and with the second power of the frequency.

Figure 2:
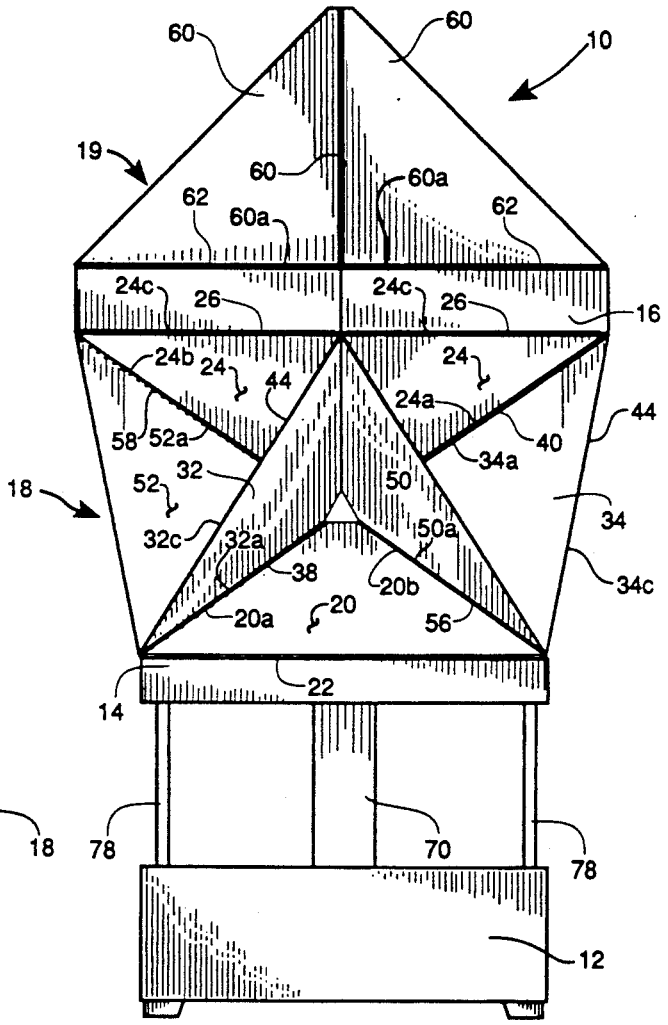
FIG. 2 is a side view of the radar retro-reflector shown in FIG. 1.

The radar retro-reflector 10 comprises a housing 12 containing a piston assembly 70 and alignment rods 78 supporting a base 14 and a platform 16. Between base 14 and platform 16, and on top of platform 16, are positioned a plurality of three-corner retro-reflectors 18 and 19, respectively. Referring to FIG. 2, which shows the retro-reflector 10 in greater detail, base 14 and platform 16 are square shaped and have the same outer dimensions.

The platform 16 is rotated about a vertical axis with respect to base 14 so that it is offset 45° relative thereto. Hingedly connected to base 14 are a set of four quarter panels 20 (one of which is seen in FIG. 2). Each panel 20 is of a right angle isosceles triangle configuration and is connected by a hinge 22 along a hypotenuse edge **20*c* to a side of base 14. Another set of four quarter panels 24 (two of which are seen in FIG. 2) are hingedly connected to platform 16. Each panel 24 is identical to the panels 20 and is connected by a hinge 26 along a hypotenuse edge 24*c* to a side of platform 16**.

A third and fourth set of four quarter panels 32 and 34 (one each of which is seen in FIG. 2) are hingedly connected to an adjacent side edge **20*a* and 24*a* of panels 20 and 24, respectively. The panels 32 and 34 are identical to panels 20 and 24 and are connected along an adjacent side edge 32*a*, 34*a* thereof by hinges 38 and 40, to the adjacent side edges 20*a*, 24*a* of panels 20 and 24. Panels 32 and 34 are also hingedly connected to each other along their hypotenuse edges 32*c*, 34*c* by hinges 44**.

A fifth and sixth set of four quarter panels 50 and 52 (one each of which is shown in FIG. 1) are hingedly connected to the remaining adjacent side edges **20*b* and 24*b* of panels 20 and 24, respectively. The panels 50 and 52 are identical to panels 20, 24, 32 and 34 and are connected along an adjacent side edge 50*a*, 52*a***, by hinges 56 and 58, to the adjacent side edges 20*b*, 24*b* of panels 20 and 24.

The panels 20, 24, 32, 34, 50 and 52 comprise a total of 24 panels, and define eight trihedral retro-reflectors mounted circumferentially around the periphery of base 14 pointed alternately slightly above and below the horizon when the radar retro-reflector 10 is level. An optional set of four additional quarter panels 60 (three of which are seen in FIG. 2) may be deployed on top of platform 16 to provide additional coverage for higher angles of elevation, and also to compensate for rotational movement of radar retro-reflector 10 caused by rolling of ship 30. The panels 60, which are identical to panels 20, 24, 32, 34, 50, and 52 are hingedly connected along adjacent side edges 60*a* to an upper surface 16*a* of platform 16, by hinges 62 extending diagonally across the upper surface 16*a*. The panels 60 are positioned in back-to-back relationship to define four additional trihedral retro-reflectors. The base 14, platform 16 and panels 20, 24, 32, 34, 50, 52 and 60 are preferably made of thin sheet aluminum or honeycomb aluminum sandwich or other lightweight, rigid metal material that is highly reflective of electromagnetic radiation.

The hinges 22, 26, 38, 40, 44, 56, 58 and 62 are connected to the individual panels, to base 14, and to platform 16 by suitable fasteners such as screws or rivets (not shown). As will be described later in greater detail, the radar retro-reflector 10 is adapted, by virtue of its hinged interconnection to be collapsible to a folded storage position, as shown in FIG. 3.

Figure 3:
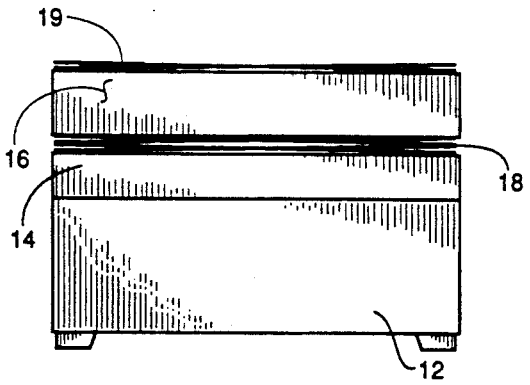
FIG. 3 is a side view showing the radar retro-reflector of FIG. 2 in a collapsed or folded position.
Figure 4:
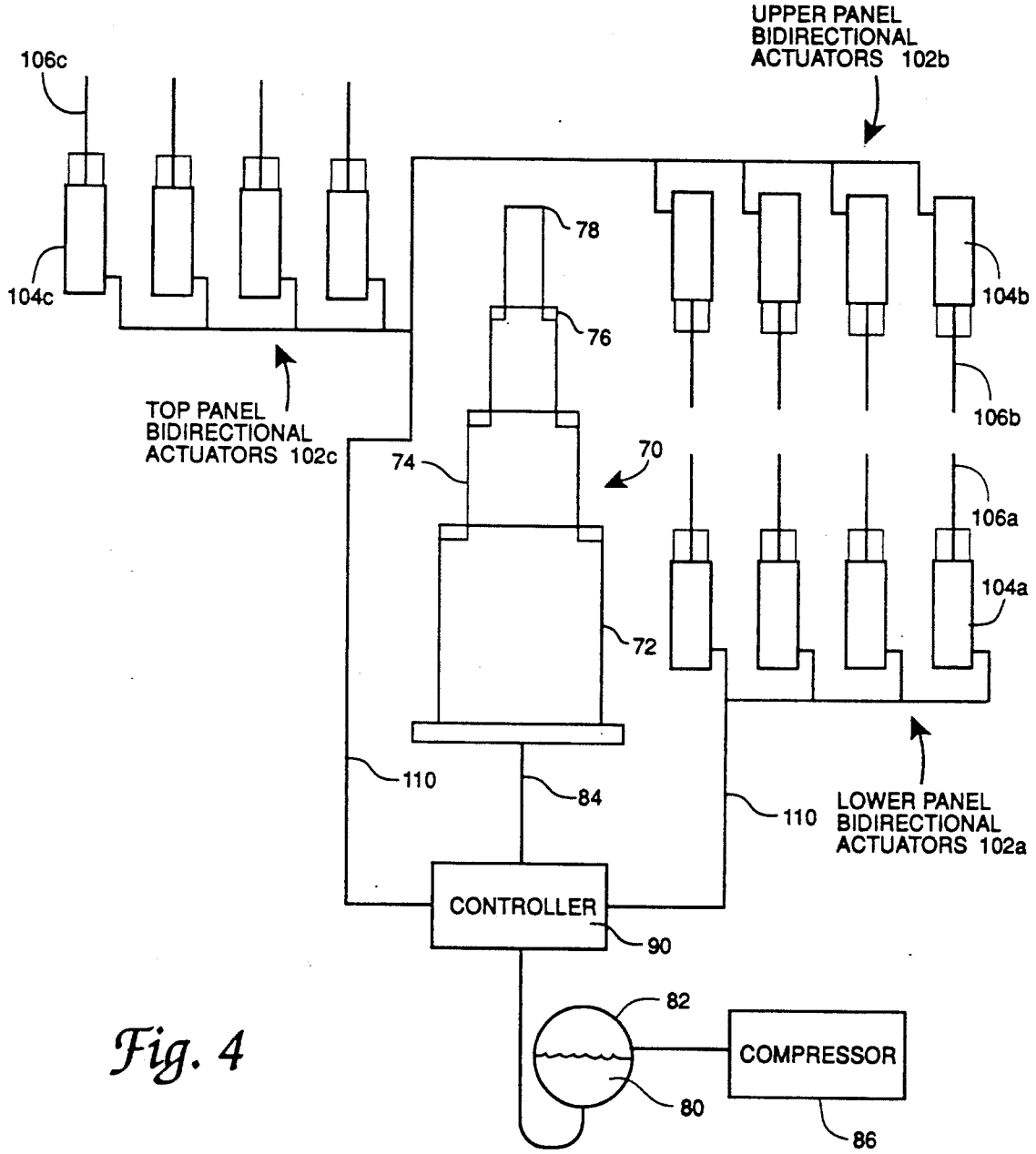
FIG. 4 shows a schematic diagram of a hydraulic system for deploying the radar retro-reflector according to the present invention.
Figure 5A:
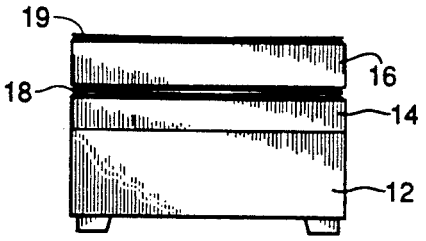
FIGS. 5 *a–e* are a sequence of side views showing the deployment of the radar retro-reflector of FIG. 2 from a folded, stored position to a fully operational deployed position.
Figure 5B:
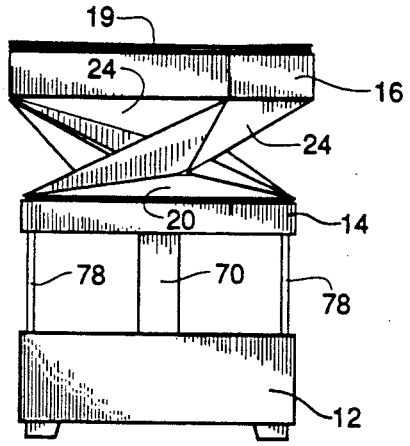
Figure 5C:
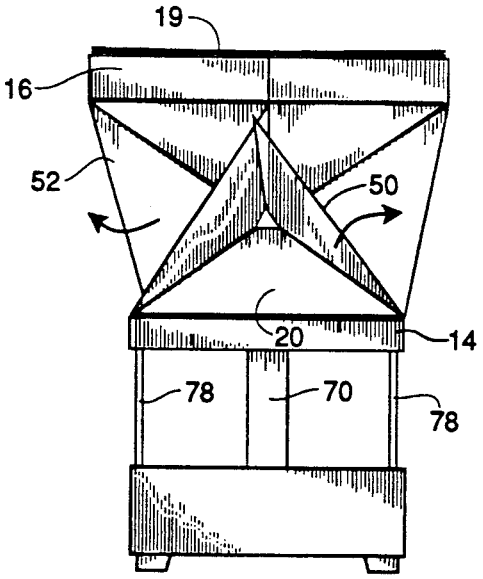
Figure 5D:
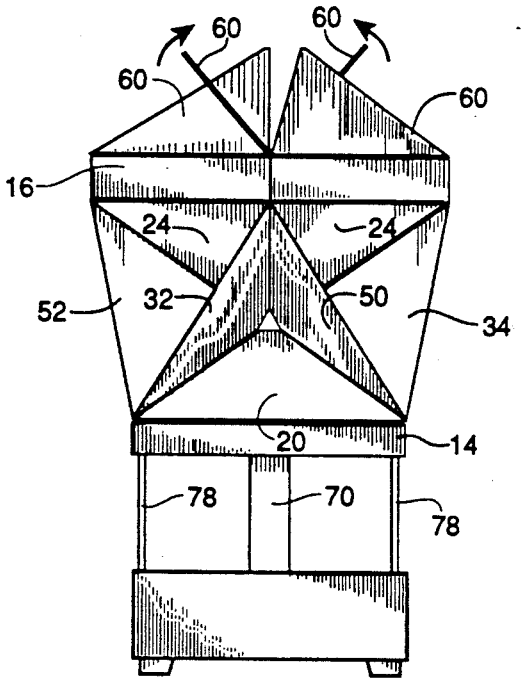
Figure 5E:
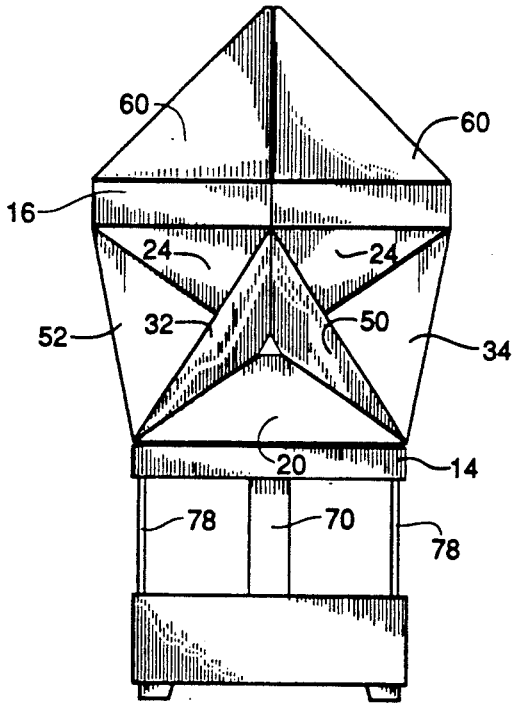

FIG. 4 illustrates a system for deploying the radar retro-reflector 10. The system comprises a hydraulically driven piston assembly 70 having a cylinder 72 and a multi-stage piston 74 movable relative thereto. The cylinder 72 is secured within the housing 12 of the radar retro-reflector 10 and piston 74 has an intermediate end 76 connected to a base 14 and an outer end 78 which is connected to platform 16. Movement of piston 74, as will be described in greater detail in the subsequent description of FIG. 5, causes the base 14 and platform 16 to move from the stored position of FIG. 3, to the deployed operational position of FIG. 2. A supply of hydraulic fluid 80 for the piston assembly 70 is provided by reservoir 82, and fluid pressure is provided by a compressor 86. Other means of providing pressure, such as bottled gas, may also be used. A controller 90, which may be manually operable, or automatically operated by a microprocessor, controls the flow of fluid 80 through a fluid line 84 to and from the piston assembly 70, causing movement of the piston 74, as is well known in the art.

The extension of piston 74 causes the first, second, third, and fourth sets of four quarter panels 20, 24, 32 and 34 to move from the folded position of FIG. 3 to the unfolded or deployed position of FIG. 2. Movement of the fifth and sixth sets of four quarter panel 50 and 52 is controlled by panel actuators 102*a*, 102*b* respectively. The panel actuators 102*a* and 102*b* are bidirectional hydraulic piston assemblies each having a cylinder 104*a*, 104*b* and a piston 106*a*, 106*b* movable relative thereto. The panel actuators 102*a*, 102*b* are supplied with hydraulic fluid 80 from reservoir 82 through fluid lines 110. The direction of flow of fluid 80 is controlled by controller 90 to cause the pistons 106*a*, 106*b* to extend from or contract in cylinders 104*a*, 104*b*. The cylinders 104*a* are secured within base 14 and pistons 106*a* are connected to the panels 50. Similarly, the cylinders 104*b* are secured within platform 14 and pistons 106*b* are connected to the panels 52. Movement of the seventh set of four quarter panels 60 is controlled by panel actuators 102*c*, which are identical in operation to panel actuators 102*a* and 102*b*. The panel actuators 102*c* have cylinders 104*c* secured to platform 16 and piston 106*c* connected to the panels 60. In lieu of the hydraulic system disclosed, it will be understood by those skilled in the art that other drive mechanisms, such as electromechanical servoactuators, may also be employed.

The sequence of movements that occurs in deployment of the radar retro-reflector 10 from a folded, stored position, to a deployed position is illustrated in FIGS. 5 *a–e*. Actuation of piston assembly 70 causes base 14 and platform 16 to raise from the stored position shown in FIG. 5*a*. Movement of base 14 is optional depending on the need to elevate the retro-reflectors above housing 12, for example, to provide clearance from surrounding interfering structure on a ship. As seen in FIG. 5*b*, further movement of platform 16 causes the platform 16 to separate from base 14. As this occurs, panels 20, 24, 32 and 34 which are hingedly connected to each other and to base 14 and platform 16, as described above, begin to unfold. In addition, platform 16 begins to rotate as it moves upward, to a position 45° offset from its original position in FIG. 5*a*. When platform 16 is fully extended, panels 32 and 34 will be at right angles with respect to panels 20 and 24, respectively. Panels 50 and 52 are then deployed (by actuators 102*a*, 102*b*) as the last step in completing the formation of the eight trihedral retro-reflectors as seen in FIG. 5*c*. Deployment of the optional panels 60 (by actuators 102*c*) is shown in FIG. 5*d* resulting in full deployment of the radar retro-reflector 10 shown in FIG. 5*e*.

Referring again to FIG. 1, the eight geodesic retro-reflectors 18 mounted around the periphery of base 14 provide good coverage at low angles of elevation. Each trihedral retro-reflector operates over a solid angle of about 60°, 30° on each of boresight, i.e. a line through the vertex equidistant from all three surfaces. The eight retro-reflectors are separated 45° in azimuth and 27.6° in elevation. This means that the angle between any two adjacent boresights is 45° over and 27.6° up for a total spatial angle of separation of 57.7°. Since each retro-reflector works well 30° each side of boresight, adjacent pairs have overlapping beams and thus provide solid coverage over 360°. The four additional retro-reflectors 19 positioned on top of platform 16 complete the coverage at higher angles of elevation, thus making the radar retro-reflector 10 effective at virtually all angles of incidence.

While there is shown and described herein certain specific structure embodying the invention, it will be understood to those skilled in the art that various modifications and rearrangements may be made without departing from the spirit and scope of the underlying inventive concept. For example, in lieu of panels 60, an additional set or sets of eight geodesic retro-reflectors could be stacked on top of platform 16.

I claim:

1. A foldable radar retro-reflector device comprising:

a housing;

a rectangular base, connected to said housing;

a rectangular platform above said rectangular base connected to said housing;

a first set of four triangular quarter panels, each of said first set of four triangular quarter panels having a first side edge hingedly connected to a side of said rectangular base;

a second set of four triangular quarter panels, each of said second set of four triangular quarter panels having a first side edge hingedly connected to a side of said rectangular platform;

a third set of four triangular quarter panels, each of said third set of four triangular quarter panels having a side edge hingedly connected to a second side edge of one of said first set of four triangular quarter panels;

a fourth set of four triangular quarter panels, each of said fourth set of four triangular quarter panels having a side edge hingedly connected to a second side edge of one of said second set of four triangular quarter panels;

each of said third and fourth sets of four triangular quarter panels further having a second side edge hingedly connected to each other;

a fifth set of four triangular quarter panels, each of said fifth set of four triangular quarter panels having a side edge hingedly connected to a third side edge of one of said first set of four triangular quarter panels;

a sixth set of four triangular quarter panels, each of said sixth set of four triangular quarter panels having a side edge hingedly connected to a third side edge of one of said second set of four triangular quarter panels, means for moving said platform in a predetermined spaced apart position from said base such that said first and third, and said second and fourth sets of four triangular quarter panels are positioned perpendicular to each other; and, means for moving said fifth and sixth sets of four triangular quarter panels to a position perpendicular to said first and second sets of four triangular quarter panels.

2. The foldable radar-reflector device of claim 1, wherein said first, second, third, fourth, fifth, and sixth sets of four triangular quarter panels are each of a right angle isosceles triangle configuration having the same dimensions.

3. The foldable radar-reflector device of claim 2, wherein said first, second, third, fourth, fifth and sixth sets of four triangular quarter panels are made of aluminum.

4. The foldable radar-reflector device of claim 3, further including a first set of four panel actuators, each actuator comprising a cylinder connected to said base, and a movable piston in said cylinder and having an end connected to one of said fifth set of four triangular quarter panels.

5. The foldable radar-reflector device of claim 4, further including a second set of four panel actuators, each actuator comprising a cylinder connected to said platform, and a movable piston in said cylinder and having an end connected to one of said sixth set of four triangular quarter panels.

6. The foldable radar retro-reflector device of claim 5, further including means for moving the pistons of said first and second sets of panel actuators in their cylinders, said means causing said fifth and sixth sets of four triangular quarter panels to move alternately from a position perpendicular to said first and second sets of triangular quarter panels to a folded position substantially parallel to said first and second sets of triangular quarter panels.

7. The foldable radar-reflector device of claim 6, wherein said means for supporting said platform spaced apart from a said base comprises a piston assembly having a cylinder connected to said housing, and movable piston in said cylinder having an end connected to said platform.

8. The foldable radar-reflector device of claim 7, further including means for moving said piston in said cylinder, said means causing said platform to move alternately from a position spaced apart from base to a position adjacent said base.

9. The foldable radar retro-reflector device of claim 8, wherein as said platform is moved from a position spaced apart from said base to a position adjacent to said base, said first, second, third and fourth sets of four triangular quarter panels move to a generally flat, folded, position.

10. The foldable radar-reflector device of claim 9, further comprising a seventh set of four triangular quarter panels, each of said seventh set of four triangular quarter panels having a side edge hingedly connected to an upper surface of said rectangular platform along two intersecting lines, and means for moving said seventh set of four triangular quarter panels to a position perpendicular to said upper surface of said rectangular platform.

11. The foldable radar-reflector device of claim 10 further comprising a third set of four panel actuators, each actuator comprising a cylinder connected to said platform, and a movable piston in said cylinder having an end connected to one of said seventh set of four triangular quarter panels.

12. The foldable radar-reflector device of claim 11 further including means for moving the pistons of said third set of panel actuators in their cylinders, said means causing said seventh set of four triangular quarter panels to move alternately from a position perpendicular to said upper surface of said platform to a folded position substantially parallel to said upper surface of said platform.

13. The foldable radar retro-reflector device of claim 12, wherein said pistons in said first, second and third sets of panel actuators, and said piston in said piston assembly are bidirectionally movable and fluid actuated.

14. The foldable radar retro-reflector device of claim 12, wherein said pistons in said first, second, and third sets of panel actuators, and said piston in said piston assembly are bidirectionally movable and electrically actuated.

15. The foldable radar retro-reflector device of claim 9 wherein said first, second, third, fourth, fifth, and sixth sets of triangular quarter panels form eight trihedral retro-reflectors arranged in a geodesic configuration circumferentially around said base.

16. The foldable radar retro-reflector device of claim 15, wherein said eight trihedral retro-reflectors are separated 45° in azimuth and 27.6° in elevation.

* * * * *